United States Patent [19]

Fischer

[11] 4,316,663

[45] Feb. 23, 1982

[54] X-RAY FILM PROCESSOR WITH SWITCHING HEATERS

[76] Inventor: Warren G. Fischer, 4N003 Wildrose Rd., St. Charles, Ill. 60174

[21] Appl. No.: 168,645

[22] Filed: Jul. 11, 1980

[51] Int. Cl.[3] ..... G03D 3/13

[52] U.S. Cl. ..... 354/299; 219/485; 34/155

[58] Field of Search ..... 354/299, 319, 320, 321, 354/322; 219/331, 485; 34/1, 155

[56] References Cited

U.S. PATENT DOCUMENTS

| | | | |
|---|---|---|---|
| 3,707,777 | 1/1973 | Geyken et al. | 354/299 |
| 4,104,668 | 8/1978 | Laar | 354/299 |
| 4,160,153 | 7/1979 | Melander | 219/485 |

*Primary Examiner*—Joseph W. Hartary
*Assistant Examiner*—Alan Mathews
*Attorney, Agent, or Firm*—Eugene F. Friedman

[57] ABSTRACT

A full sized, heavy-duty X-ray film processor operating on 20 amps. of 120 volt power supply. The processor posesses a heater for its developer, another for its fixer, and several for its drying section. The machine switches the power between the heater for the developer solution and one of the heaters for the drying section to limit its current demand. The heater for the fixer solution and another of the dryer's heaters may also not operate simultaneously to further control the processor's total current demand. By limiting the current required for its operation, the heavy-duty processor, which can develop about 175 films of size 14 inches by 17 inches per hour, operates on no more than 20 amps. of the usual 120-volt house current. The processor's circuit also includes a cycling motor which effectively turns off most of the processor's current-using components for a majority of the time. The insertion of a film into the processor, however, turns on the required components for proper film processing.

25 Claims, 5 Drawing Figures

X-RAY FILM PROCESSOR WITH SWITCHING HEATERS

BACKGROUND

Users of X-ray film processors have had a choice between two different types of machines. The first type, a small machine, processes a relatively small number of films but operates on the usual house current of 120 volts. As the alternative, a heavy-duty machine can develop a significantly greater number of films; however, it requires a power supply of 240 volts to meet the machine's requirements for electrical current.

The light-duty processor, the first type mentioned above, generally has small tanks of developer, fixer, and washing solutions as well as a small drying area. As a consequence, it requires relatively little electric current to sufficiently heat these areas to the appropriate temperatures for developing and drying X-ray film. Thus, they generally operate on the usual house electrical supply of 120 volts and use amounts of current considered permissable for such circuits.

The relatively small volume in the various sections of the processor, however, limit the number of films that can pass through it during any particular time period. Moreover, the film must move slowly through the processor in order to remain in each section for an acceptable period of time. Thus, this type of machine, in an hour, can generally process, at most, no more than about 100 pieces of 14 inch by 17 inch X-ray film.

Thus, over a set time period, the smaller machines discussed above have a limited capacity. The large, or heavy-duty, processors overcome this drawback. The number of 14 inch by 17 inch pieces of film these machines can handle may even exceed 175 pieces per hour. These greater capacity processors, however, require large-volume tanks of developer, fixer, and washing solutions as well as a large drying area. These must remain at sufficiently warm temperatures to assure the proper processing of the film in the alloted times during which it travels through the various areas of the machine. To keep the sections of the processor sufficiently warm, the machine includes separate heaters for its developer solution, fixer solution, and drying area. Powering these heaters, as well as operating the remaining components of the processor, generally requires an amount of power that precludes the use of a 120-volt supply of electrical current; the processor would require substantially more than the 20 amps. of current generally permitted for outlets providing 120-volt electricity.

Consequently, heavy-duty processors require 240 volts. As a result, the user must install special electrical service for this piece of equipment. This, in turn, may involve a substantial investment to rewire the dark room and, perhaps, even the central distribution box for the facility.

As a consequence, the user generally has to decide between a light-duty or a heavy-duty processor. The former may not have sufficient capacity for his needs, while the latter may entail a large expenditure to provide it with the required electrical service.

SUMMARY

By appropriately switching the power amongst its various heaters, an X-ray film processor can achieve large output and yet operate on a 120-volt power supply. In fact, while operating on 120 volts, it can have a current demand not exceeding 20 amps.

Typically, an X-ray film processor includes a tank containing a developer solution for X-ray film and a second tank for a fixer solution. It also includes a drying section with means for removing liquid from a processed X-ray film. Furthermore, a processor also has some type of motive device, operating on electrical power, to move a piece of film through the developer, the fixer, and then the dryer.

The processor also has some form of temperature maintaining means, operating on electrical power, to maintain the developer and fixer solutions and the drying section at or above predetermined temperatures. Furthermore, the motive device may have the ability to move, in an hour, at least 125 pieces of film of size 14 inches by 17 inches through the solutions and the dryer. The processor should then have current limiting means, coupled to the temperature-maintaining device, to limit the total current used by the processor to no more than 20 amps. of 120-volt electrical power.

Stated alternatively, the processor may include a first heater, operable on electrical current, in close proximity to one of the developer or fixer solutions. This first heater prevents the solution from falling below a predetermined temperature. The dryer may include a second heater, operating on electric current, to keep the dryer section at or above a second temperature. In this instance, the improvement of the processor includes a controller which prevents the simultaneous operation of the heaters associated with the solution and in the dryer.

Typically, an X-ray film processor includes a tank for a developer solution, a second tank for the fixer solution, and a third tank for water to clean the film. Each of the first two of these tanks has a separate heater to maintain its solution at the proper temperature. The processor also includes a drying section to remove any liquid on the film after it has undergone the developing. The dryer may contain several heaters to warm the air sufficiently to evaporate the water on the film. A blower then forces the heated air across the film to effectuate the drying.

The processor circuitry couples one of the heaters in the dryer with a heater in the developer solution; when the developer's heater operates to warm the developing solution, its coupled heater in the dryer receives no power. Similarly, the heater in the fixer solution couples with a different heater in the dryer; the latter may not operate when the former requires current to bring the fixer up to temperature. In addition, the drying section may contain additional heaters whose operation does not depend upon the temperature of any of the solutions.

With the switching of power, the processor can operate on 120 volts and use less than 20 amps. Yet, it can still have sufficient capacity to process 125, 150, or even 175 pieces of film an hour. Notwithstanding the switching of power, it can still maintain its solutions and its dryer at the required temperatures for proper film processing.

DETAILED DESCRIPTION

Figure 1:
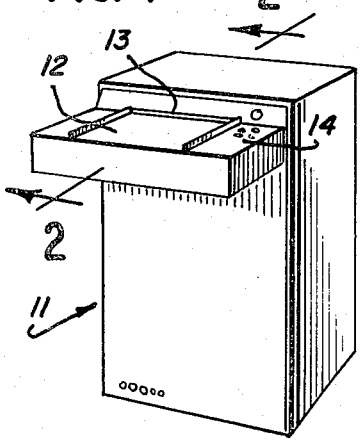
FIG. 1 provides a perspective view of a heavy-duty film processor using less than 20 amps. of 120-volt electrical power.

The processor shown generally at 11 in FIG. 1 includes the shelf 12 upon which the operator places an exposed negative of X-ray film. The film then enters the processor 11 through the opening 13. The processor also includes the lights, shown generally at 14, which indicate when the processor has achieved a satisfactory processing temperature. Lastly, the thermometer 15 indicates the temperature inside the processor 11.

Figure 2:
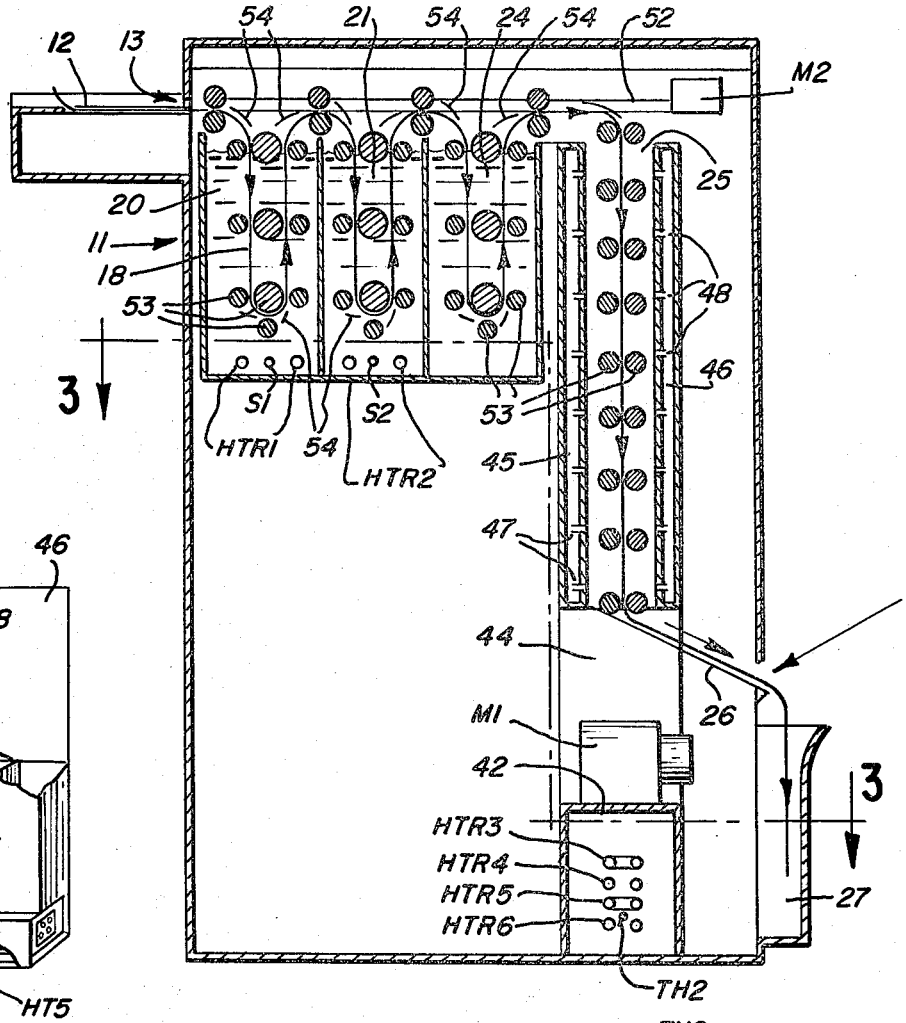
FIG. 2 gives a longitudinal cross-sectional view along the line 2—2 of the processor FIG. 1.

In FIG. 2, the course of the film through the processor 11 appears as the line 18. After the film enters the opening 13, it first goes into the tank 20 which contains developer. The developer tank 20, at its bottom, includes the heater HTR1 to warm it to its proper operating temperature. The sensor S1 provides an indication of the actual temperature within the developer tank 20.

The film then passes into the fixer tank 21 which has its heater HTR2 and sensor S2. The film then travels into the tank of water 24 which washes the film, after which it passes into the dryer section 25. After passing through the dryer 25, the film then slides along the shelf 26 into the film bin 27.

Figure 3:
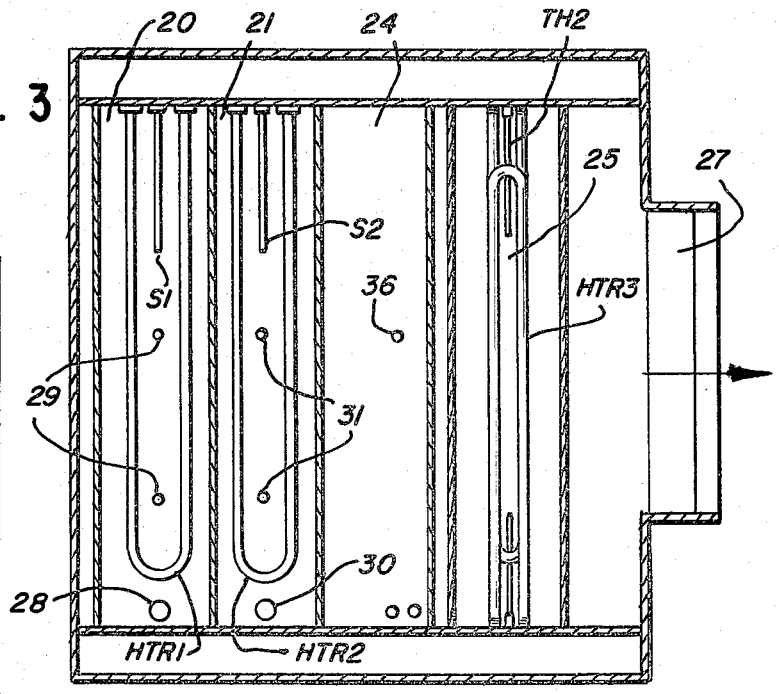
FIG. 3 has a horizontal cross-sectional view along the line 3—3 of the processor shown in FIG. 2.

As seen in FIG. 3, the developer tank 20 has the standpipe drain 28 which maintains the proper level of liquid. The tank 20 also has the two openings 29 to permit the circulation of fluid through the developer tank 20. The fixer tank 21 also has the overflow standpipe 30 and the circulation openings 31. The water tank 24 has the double standpipe 35 and the inlet 36 for fresh water.

Figure 4:
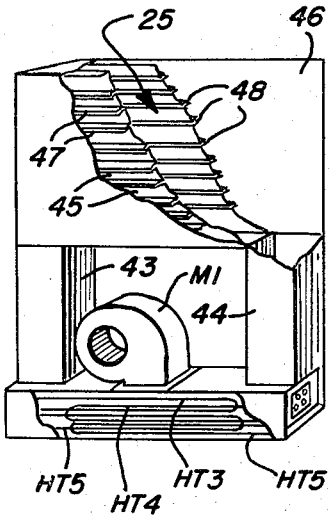
FIG. 4 portrays the path of air in the dryer section of the X-ray film processor shown in FIGS. 1 to 3.

FIG. 4 illustrates the production and movement of the hot air that dries the wet processed films in the drying section 25. The squirrel cage fan M1 forces ambient air into the lower compartment 42. There, it passes over the heaters HTR3, HTR4, HTR5, and HTR6, which raise the air's temperature. The heated air then travels upward through the side conduits 43 and 44 until it reaches the plenums 45 and 46. The air from plenums 45 and 46 pass through the openings 47 and 48, respectively, in the plenum walls and into the dryer section 25. The heated air, passing over the film, serves to evaporate any liquids that remain on it.

To move the film along its track 18, the processor includes the motor M2 which drives the gear 52. The gear 52, in turn, through various mechanical interconnections, drives the rollers 53 located in the developer, fixer, washer, and dryer sections 20, 21, 24, and 25, respectively. Lastly, the guides 54 deflect the film along a required change of path.

Figure 5:
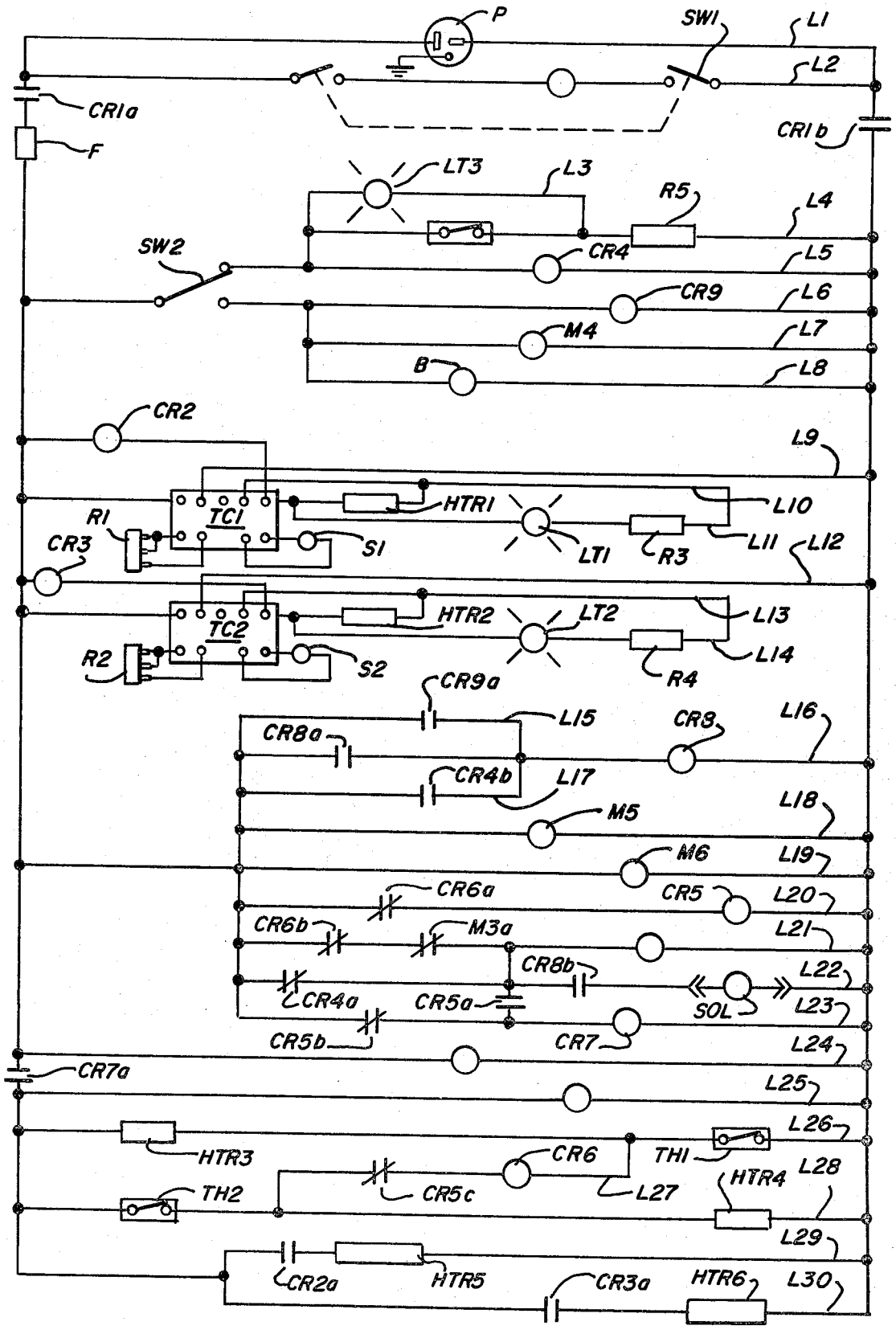
FIG. 5 gives a circuit diagram for the processor shown in FIGS. 1 to 4.

The operation of the processor begins with the closing of the switch SW1 on line L2 of FIG. 5. This applies power from the plug P to the relay coil CR1 which closes its contacts CR1*a* and CR1*b*. The rating of the switch SW1 does not permit it to carry the total amperage required by the processor. The contacts CR1*a* and CR1*b* of the relay coil CR1 can carry the full current.

In discussing the circuit of FIG. 5, the designation "CR" refers to various relays. The letters "CR" followed by only a number, for example, "CR1", refer specifically to the relay's coil. The letters "CR" followed by a number and a lower-case letter, for example, "CR1*a*" and "CR1*b*", refer to the contacts of the relay; in particular, they represent the contacts of the relay the coil of which simply bears the same designation but without the lower case letters. Thus, the contacts CR1*a* and CR1*b* form part of the relay whose coil bears the designation CR1. The line designations "L1", L2", and so forth indicate where, in the diagram of FIG. 5, the various referenced components appear.

The power then travels across the fuse F to the temperature controllers TC1 and TC2 located at lines L9 through L14. At the beginning of the processor's operation, the developer section 20 and the fixer section 21 are below their proper operating temperatures, as determined by the sensors S1 and S2, respectively. As a result, the temperature controllers TC1 and TC2 apply power to the heaters HTR1 and HTR2 seen on the lines L10 and L13, respectively.

At the same time, electricity passes through the lights LT1 and LT2, which form part of the light cluster 14 on the front of the machine in FIG. 1. These indicate that the developer and fixer solutions have not yet reached their preset temperatures and that the machine has not yet achieved a state of preparedness.

The temperature at which the controller TC1 and TC2 turn off the heaters HTR1 and HTR2, respectively, depend upon the settings of the potentiometers, or variable resistors, R1 and R2. Properly adjusting these potentiometers provides the developer with the desired temperature of 89° F. and the fixer 84° F.

When the solutions have reached these temperatures, the controllers TC1 and TC2 remove the power from the heaters HTR1 and HTR2 as well as from the lights LT1 and LT2 to turn them off. Extinguishing the lights LT1 and LT2 indicates that the solutions have reached their desired operating temperatures.

The temperature controller TC1, as it turns off the heater HTR1, due to the developer reaching its operating temperature, applies power to the relay coil CR2. This, in turn, causes the normally open contacts CR2*a* of that relay, located on line L29, to close, for the purpose discussed below. Similarly, when the temperature controller TC2 turns off the heater HTR2, the coil of the relay CR3 closes its contacts CR3*a*.

When initially turned on, the power also goes to the switch SW2 located at lines L5 and L6. The configuration of the switch SW2 depends upon whether a piece of film, at that time, is entering the processor. If not, as occurs upon the initial turning on of the machine, the switch has the configuration shown in FIG. 5 in which it connects with line L5. Should a piece of film enter the processor, the switch SW2 moves over to contact line L6.

With the switch SW2 connecting to the line L5, the power applied to the solenoid of the time delay relay CR4 will not affect the normally closed contacts CR4*a*, located at line L22, or the normally open contacts CR4*b* at line L17. Thus, the contacts CR4*a* and CR4*b* remain unaffected at least for the delay period, which in this case amounts to 180 seconds. In particular, the closed contacts CR4*a* apply power to the normally open contacts CR5*a*, waiting for the contacts CR5*a* to close.

Moreover, for the 180 seconds that the contacts CR4*a* remain closed, they apply power to the main drive motor M2. This causes the processor's rollers 53 to rotate and dislodge any material that may have adhered to them previously.

Furthermore, with the initial turning on of the processor, power appears across the normally closed contacts CR6*a*, which apply it to the time delay relay CR5. The time delay relay CR5 takes no action for its delay period of one second after receiving power. During this one-second period, several other events occur.

First, power travels across the normally closed contacts CR5*b*, on line L23; the relay CR5, due to its delay period of one second, has not yet reacted. The power across the contacts CR5*b* then travels to the relay coil CR7, also on line L23. This closes the contacts CR7*a*, located between lines L25 and L26, and provides power to the lower circuit portion composed of lines L26 through L30.

The power in this lower section specifically starts to heat up the dryer through the heaters HTR3 and HTR4. However, since the dryer has not reached its operating temperature within a second (equal to the delay period of the relay CR5) from initial turn on, both thermostats TH1 and TH2 remain closed. As a consequence, power appears across the relay contacts CR5*c*, on line L27. As a result, the relay CR6 receives power which opens its contacts CR6*a* on line L20.

Thus, the relay coil CR5 initially receives power. However, within its one-second delay period, the relay contacts CR6*a* open and remove power from the relay coil CR5. Thus, the contacts CR5*a*, CR5*b*, and CR5*c*, at initial turn on, suffer no change from their power-off configurations.

As one consequence, in particular, the relay contacts CR5*b* remain closed and apply power to the relay coil CR7. As a result, the relay contacts CR7*a* remain closed to power the bottom portion of the circuit.

The dryer section includes the two thermostats TH1 and TH2, located on lines L26 and L27, respectively, as a safety measure. At some point, the heaters HTR3 and HTR4 raise the temperature of the dryer to the preset points of the thermostats TH1 and TH2. In actual practice, one of the thermostats TH1 and TH2 will open before the other. At that point, the relay coil CR6 no longer receives power and closes its contacts CR6*a*. This latter event applies power to the relay CR5 which, after its delay period of one second, opens its contacts CR5*c* on line L27. At this point, the relay CR6 can no longer receive power. It thus remains locked out which causes its contacts CR6*a* to remain closed. The closed contacts CR6*a* cause the relay CR5 to remain powered and its contacts CR5*c* to remain open. As a result, the condition of neither relay CR5 or CR6 can change until the machine's main power at the switch S1 turns off and then turns back on.

With the relay coil CR5 thus latched on, its normally closed contacts CR5*b* at line L23 open and its normally open contacts CR5*a*, between lines L22 and L23, close. At this point, the relay CR7 receives power through the contacts CR5*a* which have now latched close and thence through the closed contacts of the time delay relay CR4*a*. Thus, for the (180 second) time delay period of the relay CR4, the relay CR7 remains powered; thus, its contacts CR7*a* remain closed to power the circuit's bottom six lines L25 to L30. As stated above, the switching of the relay CR7 occurs only after one of the thermostats TH1 and TH2 has opened. Thus, the lines L25 and L30 become dependent for their power upon the time delay relay CR4 only after the dryer section, as determined by the thermostats TH1 and TH2, has reached its proper operating temperature.

At some point, of course, the 180-second delay period of the time delay relay CR4 expires. At that point, the coil CR4 becomes energized and the normally closed contacts CR4*a*, at line L22, open. The relay coil CR7 can then receive power only through the contacts CR5*a*, now latched closed as discussed above, the relay contacts CR6*b*, on line L21, also latched closed, and the contacts M3*a*.

However, the contacts M3*a* submit to control by the cycle timer motor M3. The timer M3 simply provides cyclical on and off periods for the contacts M3*a*. Specifically, they allow the contacts M3*a* to close for three minutes and remain open for 4.5 minutes of each repeating 7.5 minute cycle. As a consequence, the relay coil CR7 receives its power on a cyclical basis, and the contacts CR7*a*, between lines L24 and L25, operate on the same cycle; the contacts CR7*a* close for three minutes interspersed with open periods of 4.5 minutes.

Thus, all the components found on lines L25 through L30, after the initial 180-second period, only operate for three minutes out of every 7.5 minute cycle. Additionally, during this time, the heater HTR5 can only operate when the relay contacts CR2*a* close. This only occurs when the temperature controller TC1 determines that the developer heater HTR1 has warmed the developer to its proper operating temperature. At this point, it provides power to the relay coil CR2. Similarly, during this three-minute period, the heater HTR6 in the dryer can only operate during those times that the temperature controller TC2 determines that the fixer has reached its temperature; it then energizes the relay coil CR3 so that the contacts CR3*a* can close on line L30.

Furthermore, the main drive motor M2, on line L21, also receives its power across the contacts M3*a*. Thus, it too operates on the 3-minute-on-and-4.5-minute-off cycle.

The blower motor M1, the main drive motor M2, and the heaters HTR3 to HTR6 undergo this cycling to conserve energy. Nonetheless, the processor remains prepared for the introduction of a piece of film, as discussed below.

In addition, after the initial 180-second period and the resulting energization of the relay coil CR4 at line L5, its contacts CR4*b*, at line L17, close. This, in turn, energizes the relay coil CR8 at line L16. The energization of the coil CR8 causes the normally open contacts CR8*a*, also on line L16, to close. As a result, the energization of the coil CR8 after the initial 180-second period causes its own contacts CR8*a* to close and assures the relay coil CR8 of continuing energization. As a consequence, the coil CR8 becomes latched on.

The latching on of the coil CR8 also causes its contacts CR8*b*, at line L22, to close. The closing of the contacts CR8*b* in turn provides power to the water valve solenoid SOL, also at line L22. The water valve, inserted in the water line leading to the washing tank 24 in FIGS. 2 and 3, then opens and provides the wash tank 24 with a continuing infusion of fresh water.

The relay contacts CR8*b*, and the coil CR8, must, however, await the initial time delay period of 180 seconds induced by the coil CR4 at line L5. In other words, the solenoid valve SOL remains closed for this initial three-minute period and prohibits the passage of fresh water into the washer tank 24. Thus, the solenoid valve SOL remains closed for this initial three-minute period. This prevents the fresh water, always cooler than the operating temperatures of the processor's other sections, from inhibiting the initial warming of the processor's components.

After the initial three-minute period, the water solenoid valve SOL opens and closes on the same 7.5 minute cycle determined by the contacts M3*a*. In other words, it allows the entrance of fresh water for three minutes and prevents the introduction of the cooler liquid for the remaining 4.5 minutes of the cycle.

The fresh cool water, in addition to assuring a clean wash for the developed films, also helps keep the other components of the processor from overheating. Thus, the heaters HTR1 to HTR6 prevent the temperature of the processor's components from falling below a desired level. The water permitted into the processor's washer tank 24 by the water solenoid valve SOL keep the processor from overheating.

The introduction of a piece of film into the processor causes the switch SW2 to move from its position in contact with line L5 to its contact position with line L6. This produces several results. First, it provides power to the metering pump M4. This pump M4 supplies the developer tank 20 and the fixer tank 21 with premeasured respective amounts of the indicated chemicals. This supply replenishes the two tanks with the chemicals expended in developing an average piece of film.

Secondly, the introduction of the film through the switch SW2 provides power to the bell B. The bell B, however, will not ring until the switch SW2 breaks its contact with the line L6 and removes the power from the bell B. At this point, the bell B rings and informs the operator that he can now introduce the next piece of film into the processor.

Third, the introduction of film closing the switch SW2 applies power to the relay coil CR9 on line L6. This closes the normally open contacts CR9*a* on line L15 and provides power to the relay coil CR9 on line L6. This closes the normally open contacts CR9*a* on line L15 and provides power to the relay CR8. Again, this would force the relay CR8 to latch on through its contacts CR8*a* on line L15.

The discussion above, however, indicated that the relay CR8 had become latched on by receiving power through the contacts CR4*b*, at line L17, of the time delay relay CR4. However, that only occurs after the machine has remained on for the full period of 180 seconds. Should an operator introduce a piece of film into the machine prior to the expiration of this period, the relay CR8 would not have yet become energized. As a consequence, the wash tank 24 would not receive fresh water. The introduction of the film prior to the expiration of the three minutes, through the relay CR9 and its contacts CR9*a*, forces the relay CR8 to energize. This closes the relay contacts CR8*b* on line L22 and opens the water valve solenoid SOL. Thus, the wash tank 24 receives fresh water to wash the piece of film that the operator has introduced before the expiration of the initial three minute warm-up period. This occurs although the processor may not have yet come to its operating temperature.

Lastly, the introduction of the film through the switch SW2 causes the relay coil CR4 on line L5 to lose power. As a consequence, its relay contacts CR4*a*, on line L22, immediately close and apply power directly to the main drive motor M1, at line L21. It also supplies power, as discussed above, across the closed contacts CR8*d*, to the water valve solenoid SOL, and across the closed relay contacts CR5*a* to the relay coil CR7, on line L23. The coil CR7 closes its contacts CR7*a* which then powers the blower M1, on line L25, and the heaters HTR3 to HTR5, located on lines L26 to L30.

In other words, the introduction of a piece of film causes the switch SW2 to lose contact with the line L5. As a result, the relay CR4 loses power. This causes all of the operating components, including the main drive motor M2, the water valve solenoid SOL, the blower motor M1, and the heaters HTR3 to HTR6 to operate in their normal fashion.

The relay CR4 cannot subsequently receive power until the switch SW2 returns to the line L5. This only occurs after the film has totally entered the machine. After that, the contacts CR4*a* will not close for an additional 180 seconds. This delay period assures that the processor operates properly for sufficient time to allow the film to pass entirely through the machine.

Once completely introduced, a piece of film takes about 120 seconds to pass through the processor. The 180-second time period, introduced by the time delay relay CR4, gives an operating period of at least 50 percent longer than the time required for the film to move through the machine.

After the expiration of the 180-second time period induced by the time delay relay CR4, the contacts CR4*a* open. The processor's cycling components, including the drive motor M2, the water valve solenoid SOL, the blower M1, the heaters HTR3 to HTR6 then return to their cycling, energy saving mode. These components cycle, of course, to save energy since they need not remain on when the processor has no film to work upon. As soon as the processor receives a piece of film, these components immediately go to their full operational status in order to properly process the film.

Lastly, the two recirculation pumps M5 and M6 always receive power and thus operate continuously during all of the time that the machine remains turned on. These pumps circulate the fluids in the developer and fixer tanks. Their constant state of operation assures that these fluids remain thoroughly stirred and mixed.

The components of various manufacturers can find acceptable use in the circuit of FIG. 5. The table below gives one set of components that has worked well.

TABLE

Components Used in FIG. 5

| Identification | Component |
|---|---|
| B | Artisan Electronics SA-106 |
| CR1, CR7 | Deltrol Controls 900 DPST-NO |
| CR2, CR3 | Magnecraft Electric W6110ASX-1 |
| CR4 | Deltrol Controls 166TD 30100-87 |
| CR5 | Deltrol Controls 166TD 30100-80 |
| CR6, CR8, CR9 | Deltrol Controls 101U DPDT |
| F | Bussmann Mfg. SC-20 |
| HTR1 | Watlow Industries U3-32-343-4 |
| HTR2 | Watlow Industries U3-32-343-3 |
| HTR3, HTR4, HTR6 | Watlow Industries 1-32-34-18 |
| HTR5 | Watlow Industries 1-32-32-19 |
| LT1, LT2, LT3 | Sorenson Lgtd. Cntrls. Series R |
| M1 | Dayton Elec. Mfg. 2C906 |
| M2 | Bodine Electric NSI-53R |
| M3 | Bristol Saybrook C11 |
| M4 | Gormann-Rupp Indust. M13196-001 |
| M5, M6 | March Mfg. AC-1A-MD |
| R1, R2 | Watlow Winona A6-006-263 |
| R3, R4, R5 | Allen-Bradley HB1041 RC47GF104K |
| S1, S2 | Watlow Winona 03-0167 |
| SOL | Skinner Elect. Valve V52DB2100 |
| SW1 | Carling Elect. TIGL 50-IL-WH-FN |
| SW2 | Cherry Elect. Prod. E-51 |
| TC1, TC2 | Watlow Winona 04-03-07 |
| TH1, TH2, TH3 | Fenwal 30000-48 |

Accordingly, what is claimed is:

1. In an X-ray film processor having:

(A) a first tank for containing a developer solution;

(B) a second tank for containing a fixer solution;

(C) first and third heating means, operable on electrical current, in close proximity to one and to the other of said first and second tanks, respectively, for maintaining a solution in said one tank and said other tank at or above a first and a third predetermined temperature, respectively;

(D) a drying section with drying means for removing liquids form a processed X-ray film, said drying means including second and fourth heating means, operable on said electrical current, in close proximity to said drying section, for maintaining said drying section at or above a second and fourth predetermined temperature, respectively; and (E) motive means, operable on said electrical current, for moving a piece of film through said first tank, said second tank and said drying section, said motive means being able to move at least 125 pieces of film of size 14 inches by 17 inches through said solutions and drying means in an hour, the improvement comprising controlling means, coupled to said first and second and third and fourth heating means, for preventing the simultaneous operation of both said first heating means and said second heating means and for preventing the simultaneous operation of both said third heating means and said fourth heating means.

2. The improvement of claim 1 wherein said controlling means, when the solution in said one tank and the solution in said other tank fall below said first and said third temperatures, respectively, prevent the operation of said second heating means and said fourth heating means, respectively.

3. The improvement of claim 1 including fifth heating means, operable on electric current, in close proximity to said drying section, for maintaining said drying section at or above a fifth predetermined temperature, said controlling means permitting the operation of said fifth heating means regardless of the temperatures of said one and said other of said first and second tanks, said controlling means prohibiting the operation of said fifth heating means when the temperature of said drying section is above said fifth predetermined temperature.

4. The improvement of claim 3 further including cycling means having repeating cycles of a predetermined length of time, said cycling means preventing the operation of said second, fourth, and fifth heating means during a predetermined portion of said repetitive cycles and permitting the operation of said second, fourth and fifth heating means during the remaining protion of said repeating cycles.

5. The improvement of claim 4 wherein said controlling means prevents the operation of said second and fourth heating means when the solutions in said one and said other of said tanks, respectively, are below said first and said third predetermined temperatures, respectively, and further including starting means for, when said processor first receives electrical power, providing electrical power to said fifth heating means, regardless of which portion of said cycle said cycling means is at, for so much of a preset period of time that said drying section remains below said fifth predetermined temperature.

6. The improvement of claim 5 in a processor further including a washing solution in a third tank and water introducing means for placing fresh water into said third tank and wherein said starting means includes prevent means for prohibiting the operation of said water introducing means for so much of said preset period of time after said processor initially receives power that no film is introduced into said processor.

7. The improvement of claim 6 wherein said preset period of time is a first preset period of time and further including override means for, whenever a piece of film is introduced into said processor during said first preset period of time, causing said water introducing means to place fresh water into said third tank for a second preset period of time.

8. The improvement of claim 7 wherein said cycling means applies power to said motive means during said remaining portions of said repetitive cycles and to said water introducing means during said remaining portion of said repetitive cycles occurring after said first preset period of time and further including film-sensitive switching means for applying power to said motive means for a period of time equal to said second preset period of time.

9. The improvement of claim 8 wherein said second preset period of time is longer than the time required for a piece of film, after it has completely entered the processor, to pass completely out of said processor.

10. The improvement of claim 9 wherein said second preset period of time is at least about 50 percent longer than the time required for a piece of film, after it has completely entered said processor, to pass completely out of said processor.

11. The improvement of claim 10 wherein said fifth heating means includes first and second electrically operating heaters and including first and second temperature-sensing means, coupled to said first and second heaters, respectively, for, when detecting that said drying section has reached said fifth predetermined temperature, prohibiting said first and second heaters from operating.

12. The improvement of claim 11 including current limiting means, coupled to said heating means, for, when said electrical power has a voltage no greater than about 120 volts and said motive means is able to move at least 125 pieces of film of size 14 inches by 17 inches through said first, second, and third tanks and said drying section in an hour, limiting the total current used by said processor to no more than about 19 amps.

13. The improvement of claim 12 wherein said motive means is able to move at least 175 pieces of film of size 14 inches by 17 inches through said solutions and drying means in an hour.

14. The improvement of claim 13 wherein the total electrical current of said processor, when operating on a voltage of about 120 volts and if all of said first, second, third, fourth, and fifth heating means operated simultaneously, would exceed 20 amps.

15. In an X-ray film processor having:

(A) a first tank for containing a developer solution;

(B) a second tank for containing a fixer solution;

(C) a drying section including drying means for removing liquids from a processed X-ray film;

(D) temperature maintaining means, operable on electrical current, for maintaining (a) solutions contained within said first and second tanks and (b) said drying section at or above predetermined temperatures; and (E) motive means, operable on said electrical current, for moving a piece of film through said first tank, said second tank, and said drying section, said motive means being able to move at least 125 pieces of film of size 14 inches by 17 inches through said tanks and drying means in an hour, the improvement comprising current limiting means, coupled to said temperature maintaining means, for, when said electrical current has a voltage no greater than about 120 volts, limiting the total current used by said processor to no more than 20 amps.

16. The improvement of claim 15 wherein said motive means is able to move at least about 150 pieces of film of size 14 inches by 17 inches through said first and second tanks and said drying means in an hour.

17. The improvement of claim 16 wherein said temperature maintaining means includes first heating means, operable on electrical current, in close proximity to one of said first and second tanks, for maintaining a solution in said one tank at or above a first predetermined temperature and second heating means, operable on electric current, in close proximity to said drying section, for maintaining said drying section at or above a second predetermined temperature.

18. The improvement of claim 17 further including third heating means, in close proximity to the other of said first and second tanks and operable on electric current, for maintaining a solution in said other tank at or above a third predetermined temperature and fourth heating means, operable on electric current and in close proximity to said drying section, for maintaining said drying section at or above a fourth predetermined temperature, and wherein said current limiting means prevents the simultaneous operation of both said first and second heating means and the simultaneous operation of both said third and fourth heating means.

19. The improvement of claim 18 further including fifth heating means, located in proximity to said drying section and operable on electric current, for maintaining the temperature of said drying section at or above a fifth predetermined temperature, the operation of said fifth heating means remaining unaffected by the temperature of solutions in said first and second tanks, and wherein the total electrical current of said processor, when operating on a voltage of about 120 volts and if all of said first, second, third, fourth, and fifth heating means operated simultaneously, would exceed 20 amps.

20. The improvement of claim 19 further including:

(A) cycling means having repeating cycles of a predetermined length of time, said cycling means preventing the operation of said second, fourth, and fifth heating means a predetermined portion of said repetitive cycles and permitting the oepration of said second, fourth, and fifth heating means during the remaining portions of said repeating cycles; and (B) starting means for, when said processor first receives electrical power, providing electrical power to said fifth heating means, regardless of which portion of said cycle said cycling means is at, for so much of a preset period of time that said drying section remains below said fifth predetermined temperature.

21. The improvement of claim 20 wherein said fifth heating means includes first and second electrically operating heaters and including first and second temperature-sensing means, coupled to said first and second heaters, respectively, for, when detecting that said dryer section has reached said fifth predetermined temperature, prohibiting said first and second heaters from operating.

22. The improvement of claim 21 wherein said current limiting means limits the total current used by said processor to no more than about 19 amps.

23. The improvement of claim 22 wherein said motive means is able to move at least about 175 pieces of film of size 14 inches by 17 inches through said first and second tanks and said drying means in about an hour.

24. In an X-ray film processor having:

(A) a first tank for containing a developer solution;

(B) a second tank for containing a fixer solution;

(C) first heating means, operable on electrical current, in close proximity to one of said first and second tanks, for maintaining a solution in said one tank at or above a first and predetermined temperature;

(D) a drying section with drying means for removing liquids from a processed X-ray film, said drying means including second heating means, operable on said electrical current, in close proximity to said drying section, for maintaining said drying section at or above a second predetermined temperature; and (E) motive means, operable on said electrical power, for moving a piece of film through said first tank, said second tank, and said drying section, said motive means being able to move at least 125 pieces of film of size 14 inches by 17 inches through said solutions and drying means in an hour, the improvement comprising controlling means, coupled to said first and second heating means, for, (a) when the temperature of said one tank is at or above said first predetermined temperature, preventing the operation of said first heating means and, (b) when the temperature of a solution in said one tank is below said first predetermined temperature, preventing the operation of said second heating means.

25. The improvement of claim 24 further including third heating means, in close proximity to the other of said first and second tanks and operable on said electrical current, for maintaining said other tank at or above a third predetermined temperature, and fourth heating means, operable on said electrical current and in close proximity to said drying section, for maintaining said drying section at or above a fourth predetermined temperature, and wherein said controlling means is coupled to said third and fourth heating means and, (a) when a solution in said other tank is at or above said third predetermined temperature, prevents the operation of said third heating means and, (b) when the temperature of a solution in said other tank is below said third predetermined temperature, prevents the operation of said fourth heating means.

* * * * *